US005107169A

United States Patent [19]

Schneider et al.

[11] Patent Number: 5,107,169

[45] Date of Patent: Apr. 21, 1992

[54] CENTRAL ELECTRODE FOR SPARK PLUGS HAVING AN INTERLAYER BETWEEN THE CORE AND AN OUTER LAYER

[75] Inventors: Friedrich E. Schneider, Pforzheim; Peter Tautzenberger, Niefern-Oschelbronn, both of Fed. Rep. of Germany

[73] Assignee: G. Rau GmbH & Co., Pforzheim, Fed. Rep. of Germany

[21] Appl. No.: 530,664

[22] Filed: May 30, 1990

[30] Foreign Application Priority Data

Jun. 5, 1989 [DE] Fed. Rep. of Germany ..... 3918278

[51] Int. Cl.[5] ..... H01T 13/39

[52] U.S. Cl. ..... 313/141; 313/355

[58] Field of Search ..... 313/141, 354, 355

[56] References Cited

U.S. PATENT DOCUMENTS 1,515,866 11/1924 Marten ..... 313/355 X
2,321,840 6/1943 McDougal ..... 313/354 X
3,857,145 12/1974 Yamaguchi et al. ..... 313/141 X

*Primary Examiner*—Sandra L. O'Shea
*Attorney, Agent, or Firm*—Sprung Horn Kramer & Woods

[57] ABSTRACT

A central electrode for spark plugs of internal-combustion engines, comprising a core of a highly heat-conductive base metallic material which is provided in the region of the firing tip with a precious metal casing consisting of silver or a silver alloy with predominantly silver content. At the boundary surface between the core material and the casing at least one interlayer is provided which is oxygen-impermeable and/or prevents the formation of a eutectic between the core material and the material of the casing.

11 Claims, 1 Drawing Sheet

CENTRAL ELECTRODE FOR SPARK PLUGS HAVING AN INTERLAYER BETWEEN THE CORE AND AN OUTER LAYER

BACKGROUND OF THE INVENTION

The invention relates to a central electrode for spark plugs of internal-combustion engines, comprising a core of a highly heat-conductive base metallic material which is provided in the region of the firing tip with a precious metal casing consisting of silver or a silver alloy with a predominantly silver content.

The main requirements made of a spark plug central electrode for use in internal-combustion engines are as follows:

a) good thermal and electric conductivity, b) high corrosion resistance, c) thermal resistance at temperatures above 800° C., d) low consumption in the ignition arc.

These wide-ranging requirements can best be fulfilled by solid electrodes which consist of precious metals and their alloys in the region of the firing tip.

A design in which a firing tip of platinum or another precious metal is inserted in a copper case is described in, inter alia, U.S. Pat. No. 2,783,409. Because of the high price of precious metals, their economic use in the mass production of central electrodes has not been possible to date, and application has been limited to special cases.

Of the precious metals, silver appears particularly suitable, because it is oxidation-resistant in the required temperature range and is relatively cheap to use. It has not been possible to date to combine a firing tip of silver in a satisfactory manner with a highly heat-conductive base metallic core material, in particular with copper. The reason for this is that silver exhibits high oxygen solubility at higher temperatures. The high oxygen solubility has the effect that after only short operating times of the electrode the oxygen diffuses through the silver and comes into contact with the base core lying beneath the silver, causing the latter to be oxidised at the boundary surface. Such an oxidation layer, however, destroys the highly-conductive metallic connection between silver and core material and reduces the heat transfer considerably. There is also the danger that the increase in volume of the core material caused by the oxidation will lead to expansion of the enveloping silver case and to associated cracking of the ceramic insulator.

Another reason why the theoretically obvious combination of silver case and copper core has not been used to date is the fact that a relatively low-melting Ag/Cu eutectic is formed at the boundary surface. The melting points of 961° C. for silver and 1083° C. for copper are certainly high enough to exclude destruction by fusion. The Ag/Cu eutectic, which consists of 72% silver and 28% copper and whose melting point is only 780° C., nevertheless forms in the boundary layer. Fusion can therefore occur in the region of the boundary layer at operating temperatures of the central electrode, causing rapid destruction of the electrode.

For the reasons given, use has been made to date as central electrodes for spark plugs only of solid electrodes made of pure silver or dispersion-hardened silver, in which the connection zone with the central electrode section lies outside the region subjected to high thermal loads. The advantages of the silver electrodes consist mainly in the exceptional consumption resistance and resistance to chemical attack, so that a long service life can be achieved. Good broad-band properties can also be obtained as regards the heat value spectrum and hence the range of use of the spark plug.

SUMMARY OF THE INVENTION

The object of the invention is to create a central electrode for spark plugs of internal-combustion engines in which the favourable properties of the silver casing of a core made of a highly heat-conductive base metallic material can be fully exploited without oxide formation or the formation of a eutectic occurring in the region of the boundary layer.

The characterising feature of the invention must be regarded as the fact that there is provided at the boundary surface between core material and casing at least one interlayer which is oxygen-impermeable and/or prevents the formation of a eutectic between the core material and the material of the casing.

Although with many material combinations the formation of the eutectic has less importance compared with oxide formation and vice-versa, so that the effect of the interlayer on avoiding the formation of a eutectic or preventing the passage of oxygen can be restricted, it seems to be necessary in most cases of practical application to avoid both oxide formation in the region of the boundary layer and the formation of a eutectic by means of a common interlayer or several combined interlayers. The interlayer or interlayers, the thickness of which can be preferably less than 50 μm, can be provided both as a coating of the core material and as a layer on the inside of the casing, or be applied on both sides.

This design consisting of one or more interlayers permits the manufacture of a composite copper-silver electrode, whereby a reduction in the precious metal used of at least 50% compared with the previously known solid silver central electrode can be achieved.

It is preferable to use copper as core material and silver as the material of the casing. Other combinations of highly heat-conductive base metallic materials or alloys as core material and silver or silver alloys with predominantly silver content can however also be used with advantage in certain cases.

A design appears appropriate in which, in order to prevent the formation of a eutectic, an oxygen-impermeable interlayer is combined with a further interlayer preferably applied directly onto the core surface.

The silver casing of the electrode can in certain cases contain with advantage alloying additions, e.g. of tin or aluminium, which reduce the oxygen-permeability of the silver. If the effectiveness is adequate, the provision of a special inter-layer preventing the passage of oxygen can be dispensed with in certain cases. However, most silver alloys with reduced oxygen solubility also have reduced thermal conductivity, so that the range of use for the specified purpose is restricted. It appears particularly preferable to use oxygen-impermeable silver alloys with high thermal conductivity, preferably AgSi alloys with a silicon content of 0.05 to 0.3% by wt. The interlayer for preventing the formation of a eutectic can with advantage consist of tantalum, iron, nickel or alloys of these materials or of an AgSi alloy.

According to a suitable design, it is possible to provide at the boundary surface between core material and casing only a single interlayer which is oxygen-impermeable and prevents interdiffusion of the core material and the material of the casing. Platinum is particularly suitable for this purpose. It has been shown, surprisingly, that AuNi alloys can also be used with advantage as a single interlayer for preventing the passage of oxygen and interdiffusion between core material and casing.

By applying the features of the invention a central electrode for spark plugs is created in which a precious metal casing forming the firing tip and consisting of silver or an alloy with predominantly silver content can be combined permanently with a core of base metal without the danger of destruction in the region of the boundary layer arising.

The invention will be explained below by means of exemplifying embodiments, from which further features of the invention emerge:

BRIEF DESCRIPTION OF THE INVENTION

Figure 1:
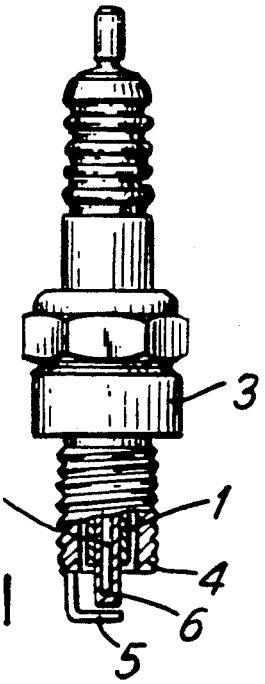
FIG. 1 is a partly cut-away view of a spark plug.

FIG. 1 represents a spark plug in which a central electrode 2 in inserted into an insulator 1. The insulator 1 is connected to a metallic screw-in part 3 which comprises at the front end of a threaded section 4 an earth electrode 5.

Figure 2:
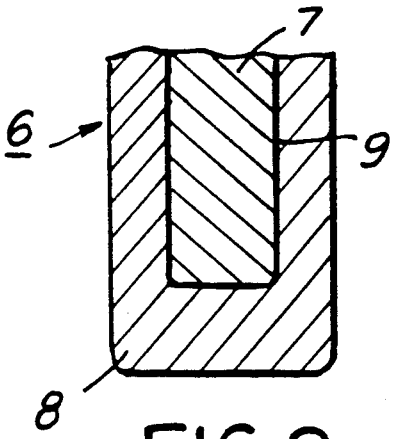
FIG. 2 is an enlarged longitudinal section through the firing tip for the spark plug according to FIG. 1.

In the region of the firing tip 6 of the central electrode a core 7 of copper, as shown in FIG. 2, is enveloped by a precious metal casing 8 of silver. At the boundary surface between the copper core 7 and the silver casing 8 is located as interlayer a platinum layer 9 about 20 μm thick which prevents both the penetration of oxygen from the silver casing to the core material and the formation of a eutectic between the core material and the material of the casing.

The casing of the core material can be produced by various known working processes, for example by deep drawing and common extrusion shaping. Various configurations can thereby be obtained at the boundary layer between the core and the silver casing.

Figure 3:
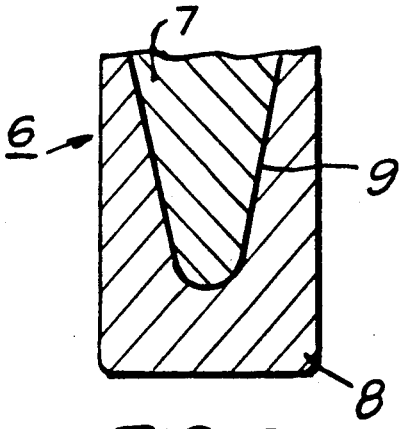
FIG. 3 is a section as in FIG. 2 for an alternative embodiment.

An advantageous design in which the silver casing 8' tapers upwards from the firing tip 6' and case 7' widens, is represented in FIG. 3. This configuration produces additional savings of the precious metal.

Figure 4:
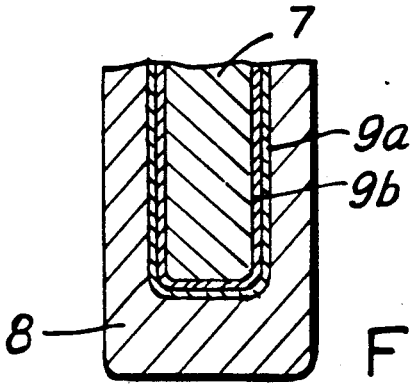
FIG. 4 is a section as in FIG. 2 for an alternative embodiment.

Instead of the single interlayer 9 shown, several interlayers **9*a*, 9*b* of different composition can also be used as shown in FIG. 4**.

What is claimed is:

1. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein said at least one interlayer comprises at least one oxygen-impermeable layer and at least one layer for preventing the formation of an eutectic.

2. The central electrode according to claim 1, wherein the thickness of each interlayer is less than 50 μm.

3. The central electrode according to claim 1, wherein the cross-section of the casing reduces with increasing distance from an end of the firing tip.

4. The central electrode according to claim 1, wherein the core consists of copper.

5. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein the casing includes alloying additions which reduce the oxygen solubility of the silver and wherein the casing consists of an AgSi alloy with a silicon content of 0.05–0.3% by wt.

6. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein the at least one interlayer for preventing the formation of an eutectic consists of tantalum.

7. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein at least one interlayer for preventing the formation of an eutectic consists of iron.

8. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein the at least one interlayer for preventing the formation of an eutectic consists of nickel.

9. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein the at least one interlayer for preventing oxygen-permeability consists of an AgSn alloy.

10. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein the at least one interlayer comprises a single layer which is oxygen-impermeable and prevents interdiffusion of the material of the core and the material of the casing and wherein the single layer consists of platinum.

11. A central electrode for a spark plug of an internal-combustion engine comprising a firing tip including a core composed of a highly heat-conductive base metallic material, a precious metal casing composed of silver or a silver alloy with a predominantly silver content, and at a boundary surface between the core and casing there is at least one interlayer which is either oxygen-impermeable or prevents the formation of an eutectic between the material of the core and the material of the casing or which is oxygen impermeable and prevents the formation of an eutectic between the material of the core and the material of the casing, wherein the at least one interlayer comprises a single layer which is oxygen-impermeable and prevents interdiffusion of the material of the core and the material of the casing and wherein the single layer consists of an AuNi alloy.

* * * * *